United States Patent [19]

Matsui

[11] Patent Number: 4,646,404

[45] Date of Patent: Mar. 3, 1987

[54] APPARATUS FOR MANUFACTURING ELECTRICAL HARNESSES

[75] Inventor: Minoru Matsui, Tsuyamashi, Japan

[73] Assignee: Nippon Acchakutanshi Seizo Kabushiki Kaisha, Osaka, Japan

[21] Appl. No.: 623,172

[22] Filed: Jun. 22, 1984

[30] Foreign Application Priority Data

| | | | |
|---|---|---|---|
| Jul. 7, 1983 | [JP] | Japan | 58-123660 |
| Aug. 15, 1983 | [JP] | Japan | 58-148965 |
| Aug. 15, 1983 | [JP] | Japan | 58-148966 |
| Aug. 30, 1983 | [JP] | Japan | 58-158747 |

[51] Int. Cl.[4] ..... H01R 43/01; H01R 43/05

[52] U.S. Cl. ..... 29/33 M; 29/564.4; 29/564.6; 29/566.1; 29/705; 29/749; 209/655; 209/924

[58] Field of Search ..... 29/564.6, 747, 749, 29/751, 857, 861, 33 M, 705, 564.8, 566.3, 709, 566.1, 865–867; 193/23, 31 A; 209/651, 655–657, 924

[56] References Cited

U.S. PATENT DOCUMENTS

| | | | |
|---|---|---|---|
| 3,294,210 | 12/1966 | Aiken et al. | 209/655 X |
| 4,043,034 | 8/1977 | Sucheski et al. | 29/747 |
| 4,110,880 | 9/1978 | Peppler et al. | 29/564.6 X |
| 4,165,768 | 8/1979 | Gudmestad | 29/564.6 X |
| 4,373,261 | 2/1983 | Long, Jr. | 29/564.6 X |
| 4,486,949 | 12/1984 | Allen | 29/861 |
| 4,495,682 | 1/1985 | Matsui et al. | 29/33 M |

FOREIGN PATENT DOCUMENTS

| | | | |
|---|---|---|---|
| 2108017 | 5/1983 | United Kingdom | 29/749 |

*Primary Examiner*—Gil Weidenfeld
*Assistant Examiner*—Steven C. Bishop
*Attorney, Agent, or Firm*—Antonelli, Terry & Wands

[57] ABSTRACT

An apparatus for manufacturing electrical harnesses, the apparatus comprising a wire feed path extending horizontally and axially of the apparatus, a connector attaching device located alongside the wire feed path. The attaching device includes a punch and a die to press the wires into the connectors, and a cutter located adjacent to the punch and die such that the cutter is operated independently of the punch and die. A wire measuring and feeding device is reciprocally movable along the wire feed path, with the wire measuring and feeding device including an intermittently movable chuck enabling the connected-attached wires to be pulled to a desired length. A connector selecting and supplying device enables the connectors having a desired number of poles to be selected from connectors and supplied onto the die. A wire selecting and supplying device includes a chuck for selecting the wires which correspond to the selected connectors and supplying the selected wires to the connector attaching device. The wire selecting and supplying device is adapted to hold the wires fed from reels, with the amount of movement and frequency of the reciprocal movements of the movable chuck being predetermined as desired. The operation of the cutter is effected only when the movable chuck is at rest, thereby ensuring that various types of harnesses are produced in which the number of poles of the connectors, the number and position thereof and the intervals thereof are determined as desired.

7 Claims, 32 Drawing Figures

APPARATUS FOR MANUFACTURING ELECTRICAL HARNESSES

BACKGROUND OF THE INVENTION

The present invention relates to an apparatus for automatically manufacturing electrical harnesses, and more particularly, to a fully automatic apparatus for manufacturing electrical harnesses including a plurality of wires and one or more multi-contact type connectors attached to the wires.

A contact-type electrical connector includes an open-topped insulating housing in which a plurality of contacts are loaded so as to accommodate a plurality of insulation clad wires, with each contact including a slot in which the wire is pressed such an insulating covering thereof is broken by the sides of the slot so as to allow electrical connection between the wire and the contact. The width of the slot is narrower than an outside diameter of the wire.

In proposed electrical harnesses, insulation clad wires are provided with a contact or contacts at one end or both ends thereof. In another type of electrical harnesses, the wires are provided with one or more contacts at the middle portion(s) thereof, which is commonly called a "through connection".

In, for example, U.S. Pat. No. 4,373,261, a semi-automatic or fully automatic apparatus for producing such harnesses of various types has been proposed.

An object of the present invention is to provide an apparatus for mass-producing electrical harnesses at high speed.

Another object of the present invention is to provide an apparatus for mass-producing electrical harnesses of various types at reduced costs.

A further object of the present invention is to provide an apparatus for mass-producing electrical harnesses in which a desired number of wires are loaded in connectors having desired number of poles, and in which the connectors are located at desired intervals.

A still further object of the present invention is to provide an apparatus for mass-producing electrical harnesses in which the electrical connection is secured between the connector and the wires loaded therein.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, an apparatus for manufacturing electrical harnesses including wires and electrical connectors comprises a wire feed path extending horizontally and axially of the apparatus, a connector attaching device located adjacent the wire feed path, with the attaching device including a punch and a die whereby the wires are pressed into the connectors. A cutter is located adjacent to the punch and die such that the cutter is operated independently of the punch and die. A wire measuring and feeding device is reciprocally movable along the wire feed path, with the wire measuring and feeding device including an intermittently movable chuck whereby the connected-attached wires are pulled to a desired length. A connector selecting and supplying device for enabling the connectors, having a desired number of poles, to selected from connectors and supplied onto the die. A wire selecting and supplying device includes a chuck for selecting the wires which correspond to the selected connectors and supplies the selected wires to the connector attaching device. The wire selecting and supplying device is adapted to hold the wires fed from reels, with the amount of movement and frequencies of the reciprocal movements of the movable chuck being predetermined as desired. The operation of the cutter is effected only when the movable chuck is at rest, thereby ensuring that various types of harnesses are produced in which the number of poles of the connectors, the number and position thereof and the intervals thereof and determined as desired.

DETAILED DESCRIPTION

Figure 1:
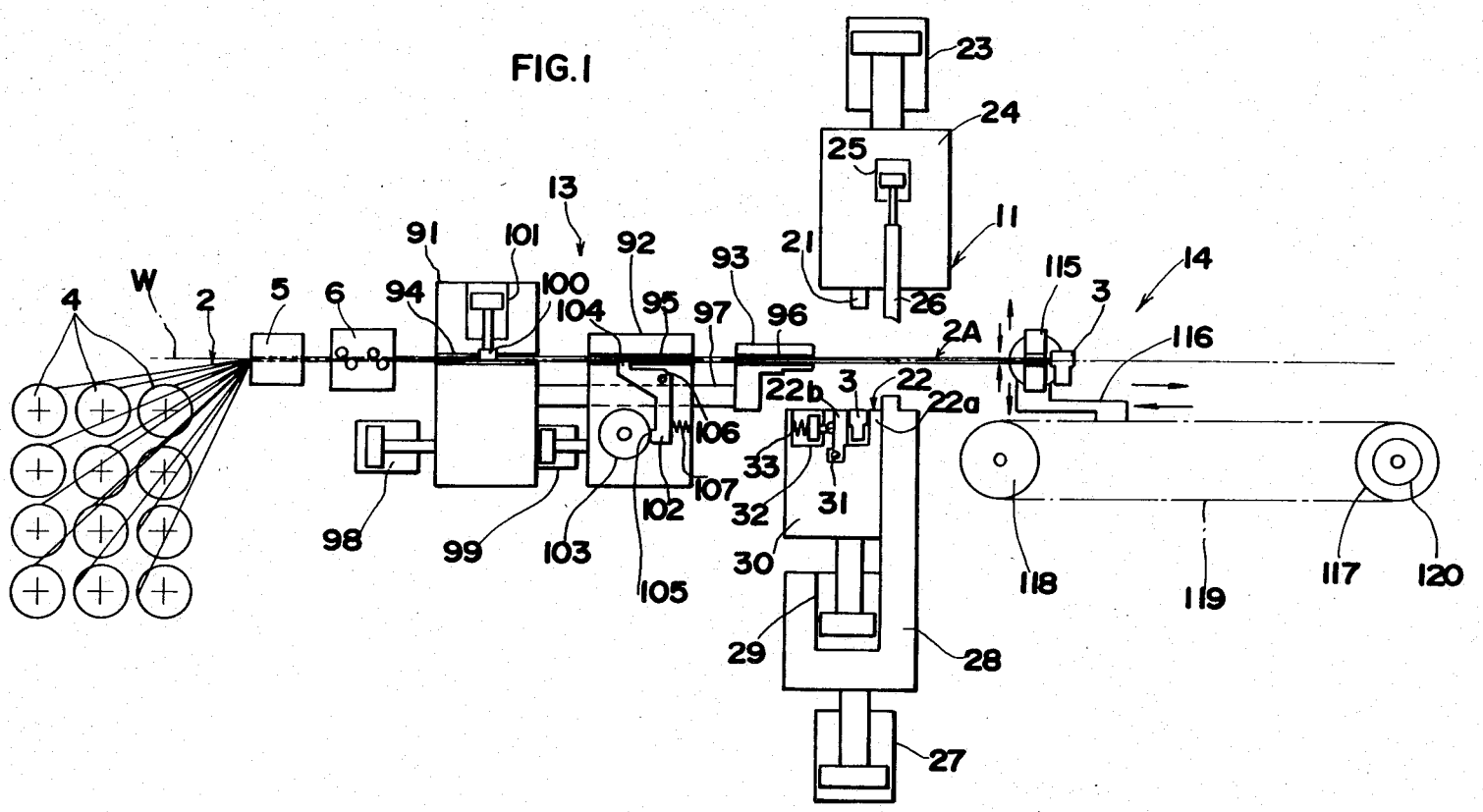
FIG. 1 is a schematic front view of one embodiment of the present invention.
Figure 2:
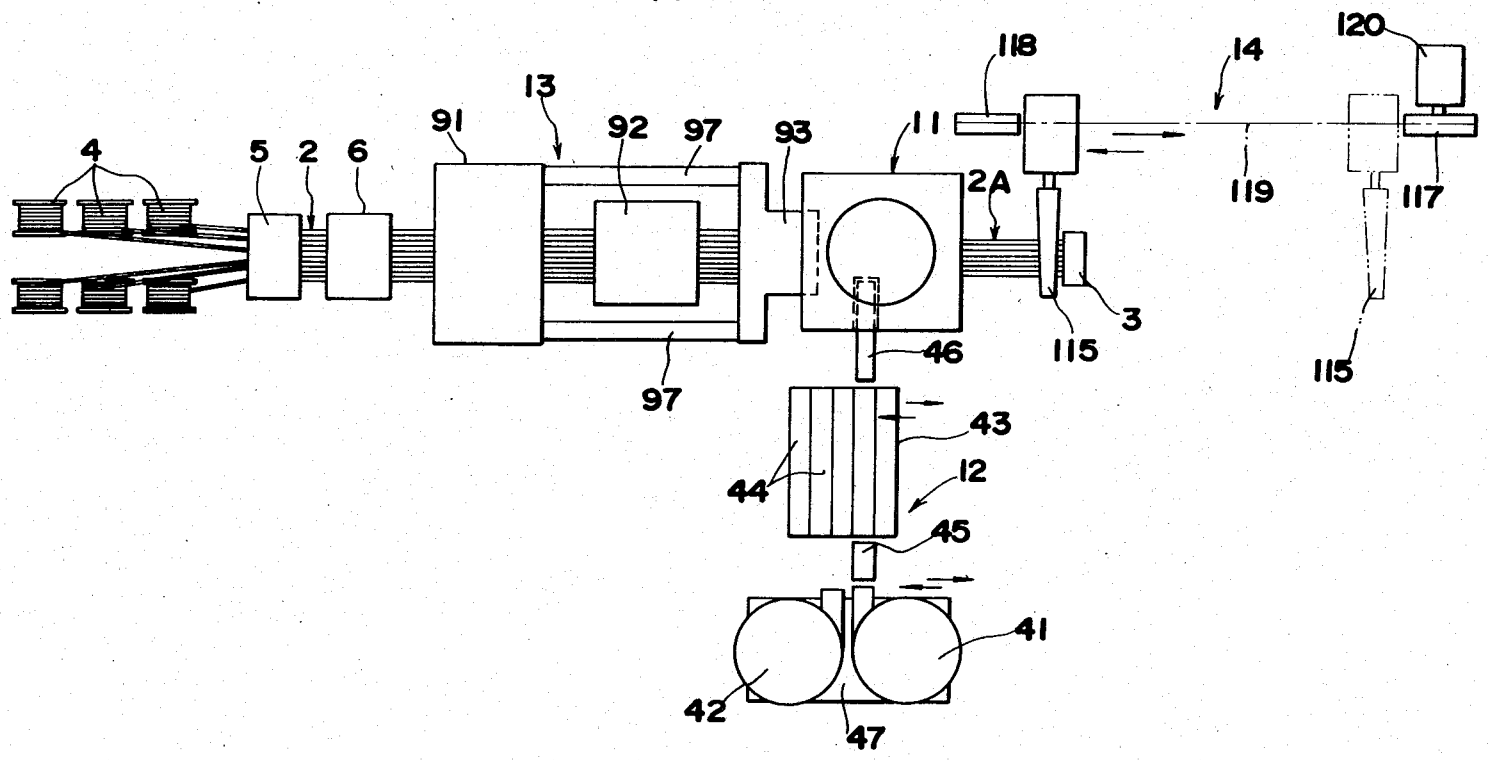
FIG. 2 is a plan view of the apparatus shown in FIG. 1.

Referring now to the drawings wherein like reference numerals are used throughout the various views to designate like parts and, more particularly, to FIGS. 1 and 2, according to these figures the apparatus of the present invention includes a connector attaching device generally designated by the reference numeral 11 for pressed fitting of contact connectors 3 to each of a group of wires 2A supplied horizontally along a wire feed path. A connector selecting and supplying device generally designated by the reference numeral 12 supplies a desired type of contact connectors 3 to the connector attaching device 11; a wire selecting and supplying device, generally designated by the reference numeral 13 supplying wires 2A to the connector attaching device 11, wherein the wires 2A are wound on a plurality reels 4 A wire measuring and feeding device 14 transfer the wires 2A provided with the connectors 3 by the connector attaching device 11 over a desired distance during an intermittent movement of the device 14.

Figure 3:
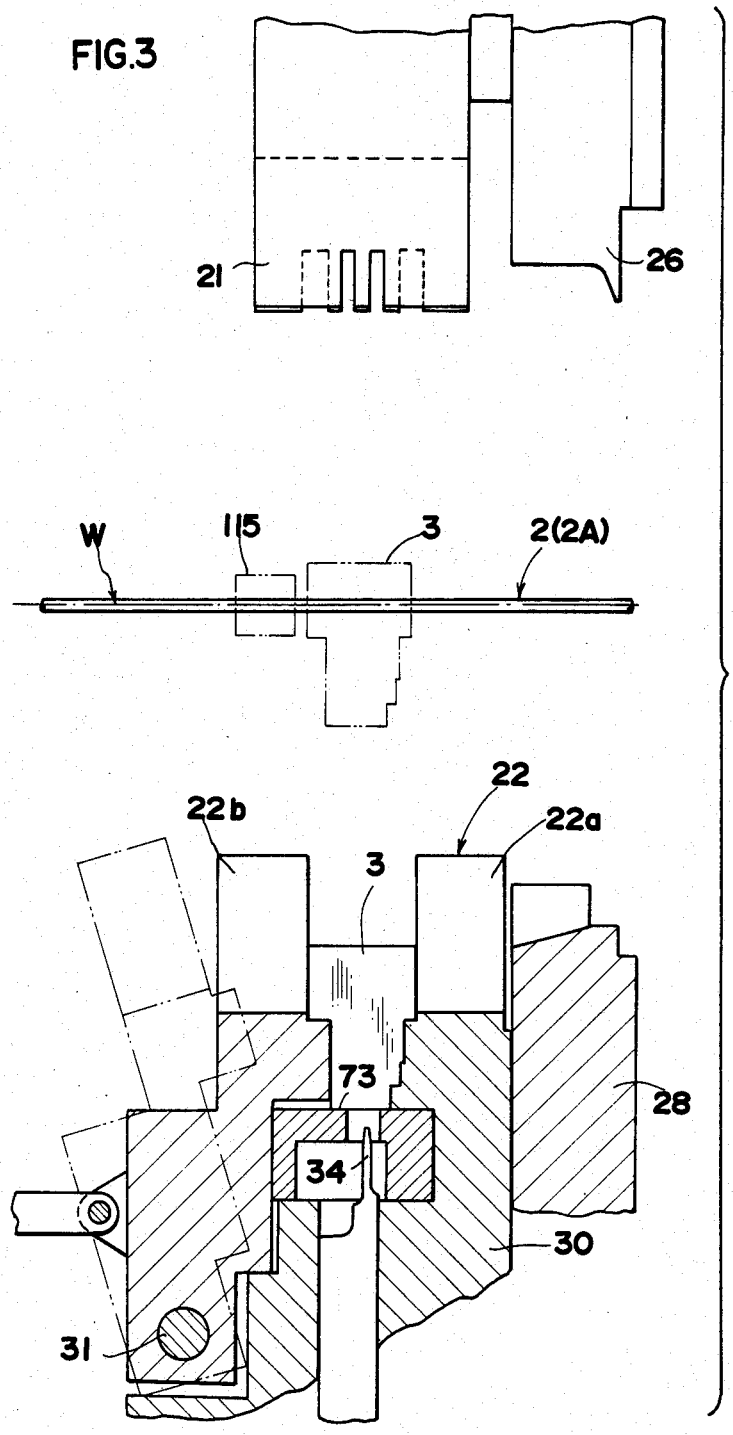
FIG. 3 is a partially cross-sectional schematic view of the connector attaching section shown in FIG. 1.

Referring to FIGS. 1 and 3 the connector attaching device 11 includes a punch 21 and an oppositely disposed die 22 located along the wire feed path W.

Figure 4:
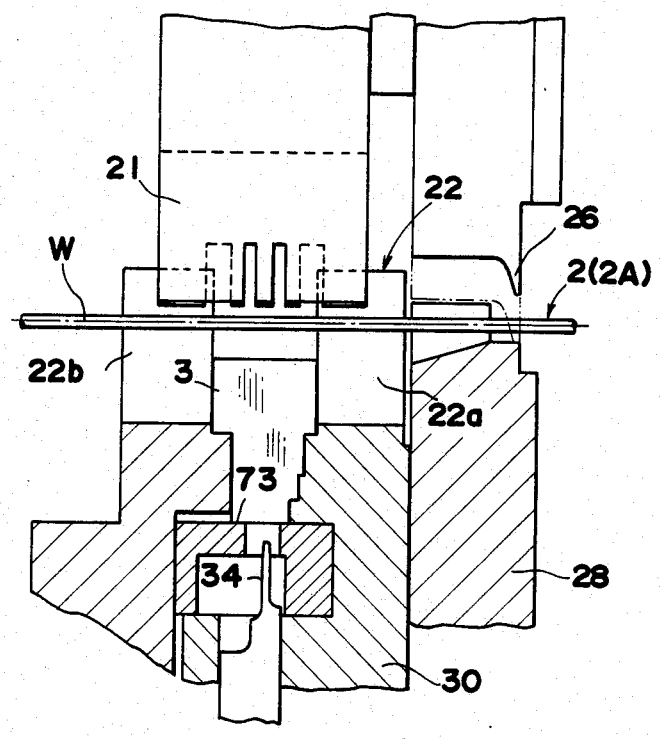
FIGS. 4 and 5 are partially cross-sectional schematic views showing the connector attaching section in operation.
Figure 5:
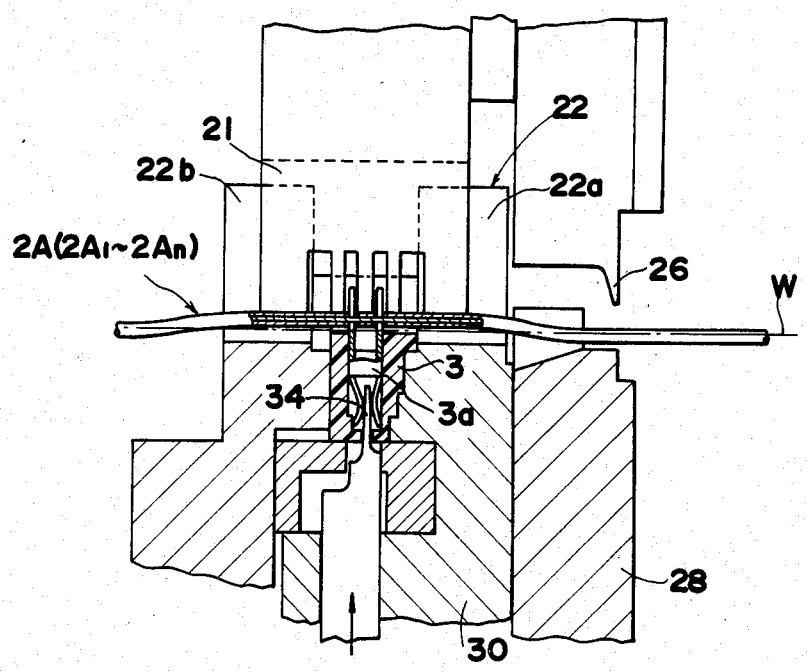

The punch 21 is mounted on a slider 24 reciprocally moved by a pneumatic cylinder 23, with the punch 21 being lowerable to a position shown in FIG. 5 at which position the connectors are fixed to the wires 2A under a pressure provided by the punch 21. FIG. 3 illustrates the punch 21 in a fully raised position, and FIG. 4 illustrates the punch 21 in a lowered position near the wire feed path W. The slider 24 includes a wire cutter 26 reciprocated by a pneumatic cylinder 25, independently of the punch 21. The cutter 26 moves, as shown by the dotted lines in FIG. 4, and cuts the wires so as to obtain aligned cut ends. The cutting operation is performed twice, that is, when the connector attaching operation starts and ends.

The die 22 is mounted on a second slider 30, which is reciprocated by a second penumatic cylinder 29 mounted on a first slider 28 reciprocated by a first pneumatic cylinder 27. The first pneumatic cylinder 27 insert causes the die 22 to rise to the position shown in FIG. 4 from that shown in FIG. 3. Subsequently, the second pneumatic cylinder 29 causes the die 22 to rise to the position shown in FIG. 5 at which the die 22 participates in the connector attaching operation in cooperation with the punch 21.

The die 22 includes a fixed die block **22*a* fixed to the second slider 30, and a laterally tiltable die block 22*b* displaceable against the fixed die block 22*a* about a pivot 31 as shown by the dotted lines in FIG. 3. The movable die block 22*b* is tiltable by a pneumatic cylinder 32 mounted on the second slider 30 as shown in FIGS. 1 and 3. The pneumatic cylinder 32 includes a spring 33 (FIG. 1), which urges the movable die block 22*b* toward the fixed die block 22*a*. A connector 3 is held between the die blocks 22*a*, 22*b*, wherein the connector 3 is slightly urged toward the fixed die block 22*a* by the movable die block 22*b*. The movable die block 22*b* is tilted sideways by the pneumatic cylinder 32, thereby opening the gap against the fixed die block 22*a***.

Figure 6:
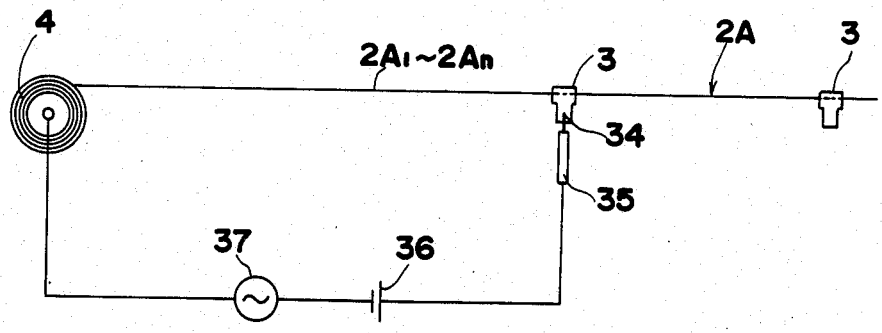
FIG. 6 is a circuit diagram of the system for checking electrical connection.

The second slider 30 is provided with a checking probe 34, and a pneumatic cylinder 35 for operating the checking probe 34, which, as shown in FIG. 5, is raised and enters the connector 3 until it contacts the contact **3*a*. The checking probe 34 is provided for determining whether each wire $2A_1$ to $2A_n$ is in electrical connection with its associated contact 3*a*. As shown in FIG. 6, the checking circuit includes a power source 36 and a detector 37, such as an anmeter or a lamp, or provided between each terminal of the wires wound around the reels 4, and the probe 34 mating therewith. When the wire is pressed into the contact to achieve electrical connection therebetween, the checking circuit is closed, and the detector 37 indicates that they are in connection with each other. The checking probe 34 is maintained in contact with the contact 3*a*, which is equal to the condition of actual use in which a pin terminal is maintained in contact with the contact 3*a***. This ensures the reliability of connection checking. Moreover, the connection checking is carried out simultaneously with the connector attaching, thereby eliminating the necessity of checking the electrical connection as a separate process which results in a saving of labor and time.

Figure 7:
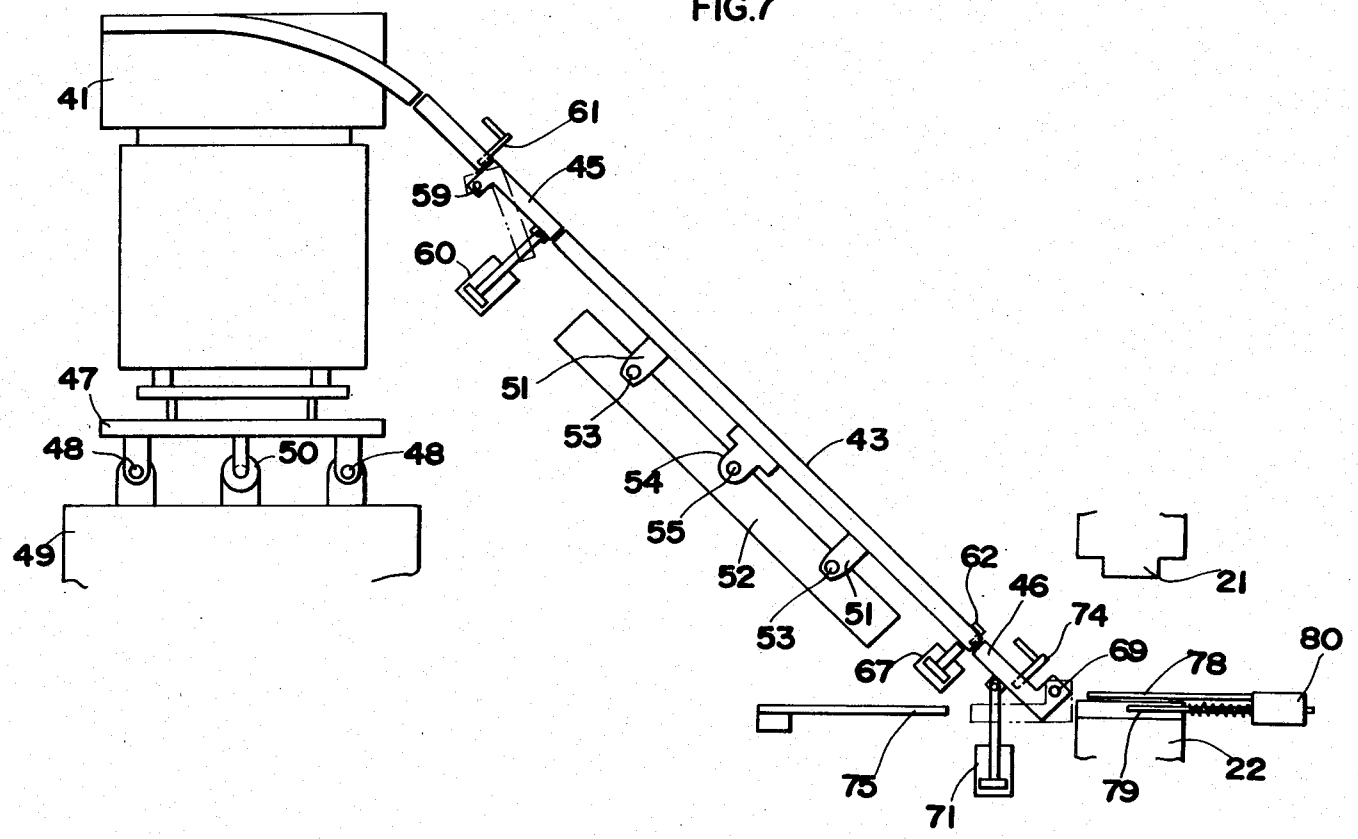
FIG. 7 is an exemplary view of the connector selecting and supplying device.

Referring to FIGS. 2 and 7, the connector selecting and supplying device 12 includes a pair of feeders 41, 42 for feeding the connectors 3 in an orderly manner, a chute 43 having a plurality of guide grooves 44 through which the connectors 3 are fed selectively in accordance with their number of poles, a transfer chute for transferring 45 the connectors 3 from the feeders 41 or 42 to the selected guide grooves 44 of the chute 43, and a distributor chute 46 for supplying a desired number of connectors 3, supplied through the guide grooves 44, to the dies 22.

The feeders 41, 42 are mounted on a base 49 through a fixture plate 47 and sliding spindles 48 in such a manner that the feeders 41, 42 are movable along the length of the base 49, as indicated by the arrow in FIG. 2. The feeders 41, 42 are alternately operated to feed the connectors 3 to the guide grooves 44 of the chute 43 via the transfer chute 45, while the other feeder is caused to change its position by moving the fixture plate 47 by means of a pneumatic cylinder 50, so as to align with the transfer chute 45 for feeding the next stock of connectors 3 thereto.

Figure 9:
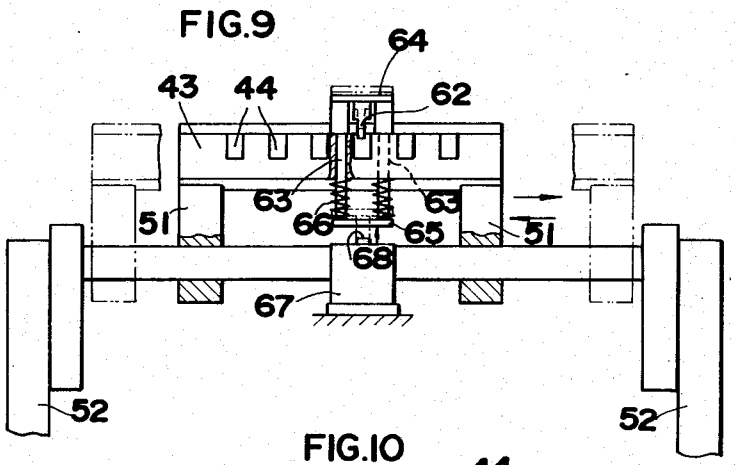
FIG. 9 is a schematic view taken along the line 9—9' in FIG. 8.
Figure 8:
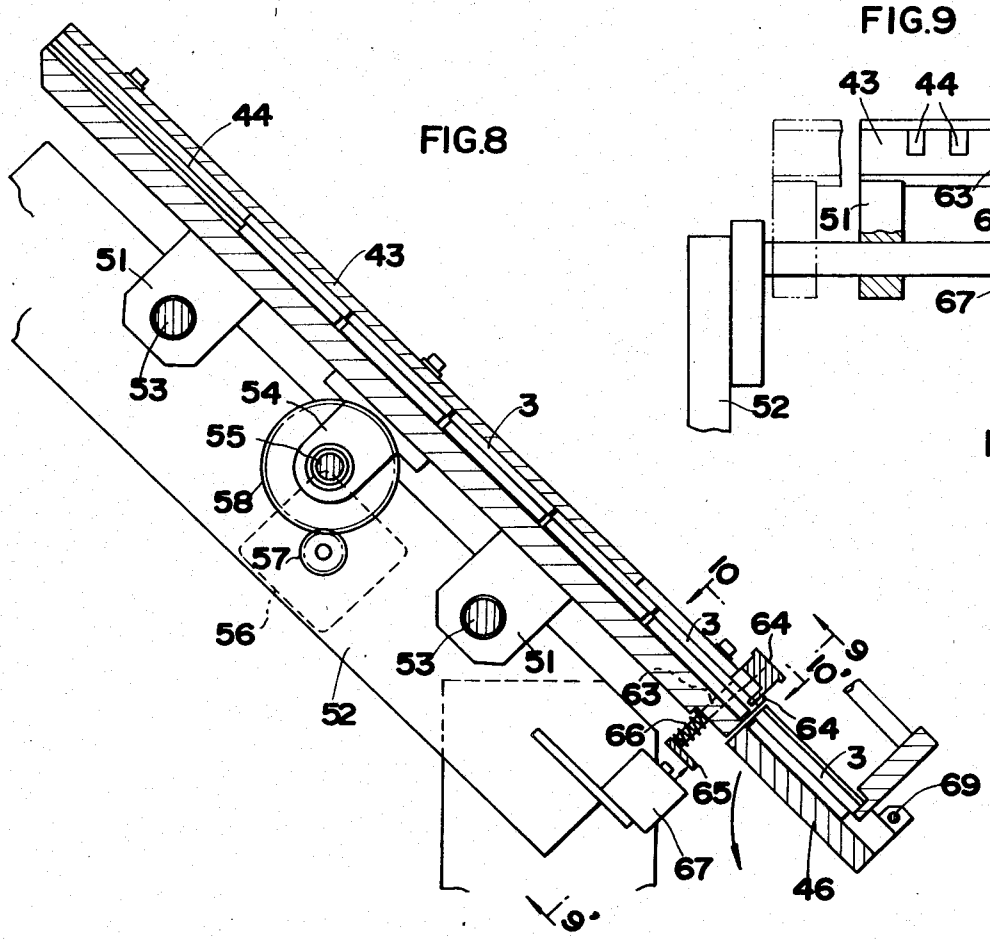
FIG. 8 is a partially cross-sectional view on an enlarged scale of the main part of the device of FIG. 6.

As shown in FIGS. 7, 8 and 9, the chute 43 is provided with brackets 51 at its bottom surface, which brackets are slidably supported on guide shafts 53 transversely supported by a framework 52 such that the chute 43 is transversely movable with respect of the framework 52 as best shown in FIG. 9. The cuts 43 is additionally provided with an internally threaded member 54 at its bottom surface, which mates with an externally threaded shaft 55 provided in parallel with the guide shafts 53 on the framework 52. The external threaded shaft 55 is rotated by a pulse motor 56 (FIG. 8) through a pinion 57 and a gear 58, the pulse motor 56 being mounted on the framework 52, and the meshing of the two threaded members 54 and 55 causes the chute 43 to move transversely in the framework 52. By moving the chute 43 the inlets of the guide grooves 44 thereof are aligned with the transfer chute 45, and the outlets thereof are aligned with the distributor chute 46. In this way the connectors 3 are ready for being fed from the feeder 41 (or 42) to the distributor chute 46 via the chute 43 and the transfer chute 45 in an orderly manner. The guide grooves 44 serve to maintain the orderly feeding of the connectors 3, wherein the guide grooves 44 accommodate connectors having different numbers of poles. The numbers of poles of the connectors are ascertained by a phototube or any other sensor so as to select the guide grooves 44.

Figure 10:
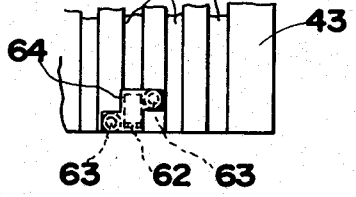
FIG. 10 is a partial schematic view, of the part indicated by the line 10—10' in FIG. 8.

The transfer chute 45 is rotatable around a pivot 59 as shown by the dotted lines in FIG. 7. The function of the rotatable structure of the transfer chute 45 is to remove the connectors if they are found by the sensor to have different number of poles than that of the connectors previously accommodated in the guide grooves 44. The transfer chute 45 is rotated by a pneumatic cylinder 60, and the reference numeral 61 designates a stop whereby the subsequent flow of connectors is prevented from discharging out of the tilting transfer chute 45. Referring to FIGS. 8 to 10, stops 62 are provided at each outlet of the guide grooves 44 of the chute 43, whereby the connectors accommodated in the guide grooves 44 are prevented from discharging therefrom. The stop 62 is fixed to an upper plate 64 supported by a pair of moving pillars 63, which are connected to each other at their bottom portions by a connecting plate 65. Springs 66 are provided between the bottom surface of the chute 43 and the connecting plate 65, whereby the stop 62 is urged downward until it is inserted in the open top of the connector located at the lowermost position in the guide groove 44. For simplicity only one stop 62 is illustrated, but, in practice, a number of stops corresponding to that of the guide grooves are provided.

A pneumatic cylinder 67 is provided near the inlet of the distributor chute 46, so as to release the connectors 3 from the stops 62. That is, when the position of the chute 43 is changed so as to enable its guide grooves 44 to align with the distributor chute 46 as desired, the pneumatic cylinder 67 is operated to cause its piston rod 68 to push the connection plate 65 upward, thereby allowing the stop 62 to be freed from the connector 3 in the guide groove 44.

Figure 11:
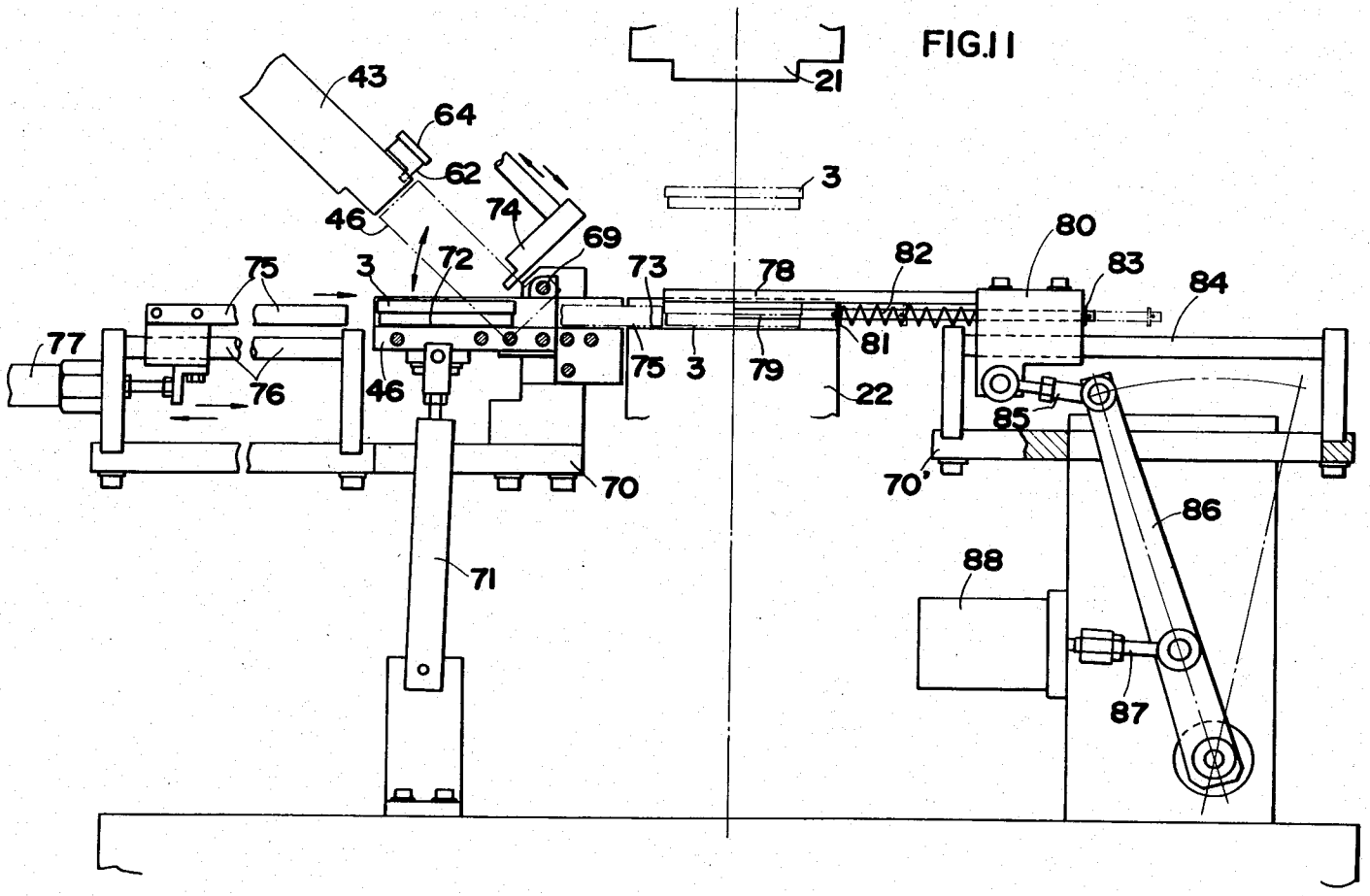
FIG. 11 is a partially cross-sectional view on an enlarged scale, of the connector selecting and supplying device.

As best shown in FIG. 11, the distributor chute 46 is pivotally connected to a fixed framework 70, and is changeable from its tilting position at which it is faced to the desired guide grooves 44 to its horizontal position at which the inside bottom 72 of the guide grooves 44 is on the same plane as the punch receiving surface 73 of the fixed die block **22*a*, and vice versa. The positional change of the distributor chute 43 is effected by a pneumatic cylinder 71. A stop 74 is insertable in the guide groove 44 when the chute 46 is the tilting position. The stop 74 is movable along the length of the chute 46 in a known manner, thereby ensuring that the stop position is adjusted with the lengths of the connectors 3. In this manner the distributor chute 46 receives a required number of connectors to be used in one attaching process, and the connectors not used are prevented from landing on the chute 46 by the stop 62** in the aforementioned manner.

A pusher 75 is provided beyond the imaginary extension of the distributor chute 46, with the pusher being horizontally slidable along a guide shaft 76 transversely supported on the fixed framework 70. The sliding movement is effected by a pneumatic cylinder 77. When advancing, it pushes the connector 3 in the distributor chute 46, thereby enabling it to be located at the operating position on the receiving surface 73 between the fixed die block **22*a* and the movable die block 22*b* (Refer to FIG. 3**).

In order to ensure that the connector 3 is located at its operating position on the receiving surface 73, an upper limiting rod 78 and a side limiting rod 79, are provided so as to regulate the connectors 3 at their top and side. The two rods 78, 79 are located in opposition to the pusher 75 beyond the imaginary extension of the distributor chute 46 in its horizontal position. The upper limiting rod 78 is fixed to a slider 80, and the side limiting rod 79 is passed through the slider 80, and is normally urged toward the die 22 by a spring 82 supported between a bracket 81 and the slider 80, wherein the bracket 81 is provided midways along the length of the side limiting rod 79. A stop plate 83 is provided at the rear end of the rod 79, and the slider 80 is slidably supported on a guide shaft 84 transversely supported on a fixed framework 70', and moved by a pneumatic cylinder 88 through a first link 85, an intermediate rod 86 and a second link 87.

Before the pusher 75 is advanced the top limiting rod 78 and the side limiting rod 79 are set to the waiting position as shown in FIG. 11, and control the connectors 3 pushed from the distributor chute 46 by the pusher 75. When the end face of the connector 3 comes into abutment with the side limiting rod 79, the rod 79 is withdrawn rearward against the spring 82, thereby enabling the individual connectors 3 to be inserted onto the receiving surface 73 as it is pinched by the pusher 75 and the side limiting rod 79. By virtue of this arrangement, the adequate adjustment of the most advanced position of the pusher 75 to the desired position ensures that the connectors 3 are exactly located at the operating positions on the receiving surface 73. When the connectors are located at their operating positions, the pusher 75 is stopped, and the rods 78 and 79 are withdrawn. Finally the pusher 75 is withdrawn. In this way one cycle of operation is finished.

The connectors are individually placed on the receiving surface 73 of the die 22 on which the connectors are held between the fixed die block **22*a* and the movable die block 22*b*. The die 22 is raised to the position shown in FIG. 4, and stopped there for a moment. Then it is further raised to the position shown in FIG. 5 at which the connector attaching operation is performed in cooperation with the punch 21**.

The word "selecting" of the connector selecting and supplying device means that the connectors having different number of poles are automatically selected as desired, and supplied to the connector attaching device 11. One advantage of the present invention is that the computerized control is made accessible.

As shown in FIGS. 1 and 2, a wire group 2 is supplied from a plurality of reels 4, and fed along the wire feed path W via a bundling section 5 and a straightener 6. Two adjacent chucks 91, and 92 having different functions are provided, with the first chuck 91 being adapted to hold all the wires fed thereto, and the second chuck 92 being adapted to hold the selected wires alone, that is, to hold the wires selected for having no connectors attached thereto, and allow the ones having the connectors attached thereto to be free therein. Additionally, a wire guide 93 is located adjacent to the connector attaching position, so as to guide the wire group 2 along the wire feed path W.

Each of the chucks 91, 92 and the wire guide 93 is provided with wire guide grooves 94, 95 and 96, respectively, whose number corresponds to the number of the wires to be processed, which in the illustrated embodiment is twenty-five The intervals of the grooves are predetermined so as to correspond to those of the wire-acommodation slots in the contact **3*a*. The wires $2_1$ to $2_{25}$ are individually held in and guided by these grooves in each device 91, 92 and 93, and are supplied to the connector attaching device 11** in an orderly manner.

The chuck 91 and the wire guide 93 are connected to each other by a pair of connecting rods 97, and they are arranged so as to be movable toward the wire feed path W by means of a pneumatic cylinder 98. The second chuck 92 is also movable toward the wire feed path W by a pneumatic cylinder 99 mounted on the first chuck 91. This means that the second chuck 92 can be moved toward the wire feed path W together with the first chuck 91 by the pneumatic cylinder 98.

The first chuck 91 has a holder plate 100 for holding all the wires, that is, the whole wire group 2 passing through the guide grooves 94. The holder plate 100 is raised or lowered by a pneumatic cylinder.

As shown in FIGS. 1, and 12 to 15, the second chuck 92 has a number of selecting blades 102 corresponding to the number of the guide grooves 95 (the illustrated embodiment has 25 selecting blades). The selecting blades are operated by a grooved drum or roller 103. Each of the selecting blades 102 has an L-shape, and is provided with a wire holding pawl 104 at its top end, and a projection 105 at the other end. Each selecting blade 102 is pivotally connected to the chuck 92 by the same supporting shaft 106 so that each blade can rotate independently of the other selecting blades 102. The selecting blade 102 is normally urged toward the grooved roller 103 by a spring 107, so as to enable the projection 105 to come into engagement with the periphery of the grooved roller 103. In this situation the wire holding pawl 104 is inserted into an opening 108 communicating with the guide groove 95.

Figure 12:
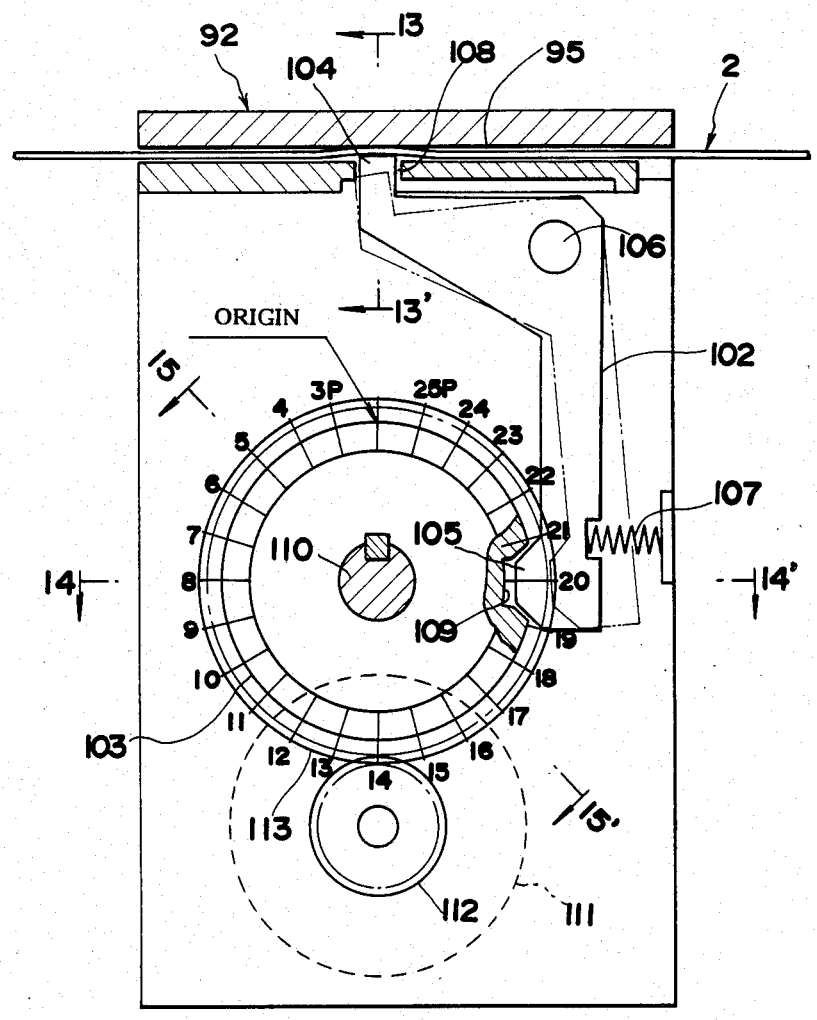
FIG. 12 is a schematic view of the chuck for selecting the wires.
Figure 13:
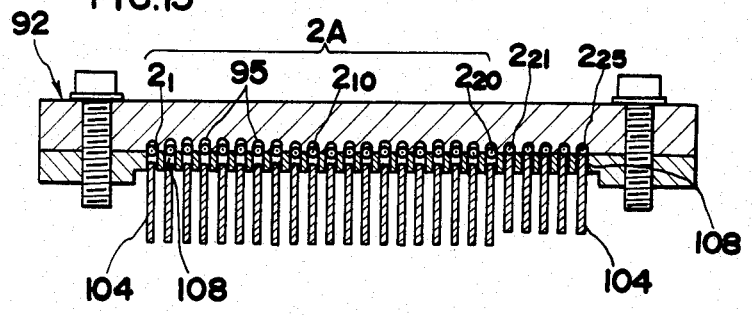
FIG. 13 is a cross-sectional view taken along the line 13—13' in FIG. 12.
Figure 14:
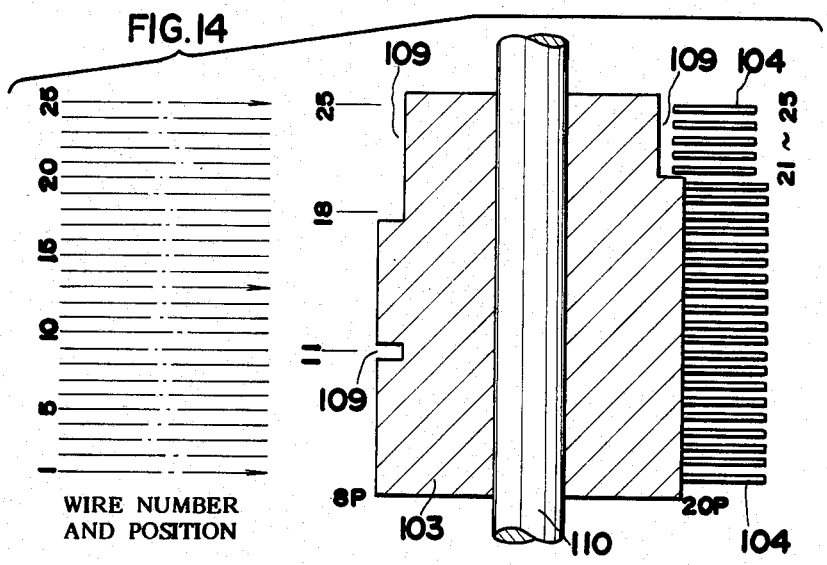
FIG. 14 is a cross-sectional view taken along the line 14—14' in FIG. 12.
Figure 15:
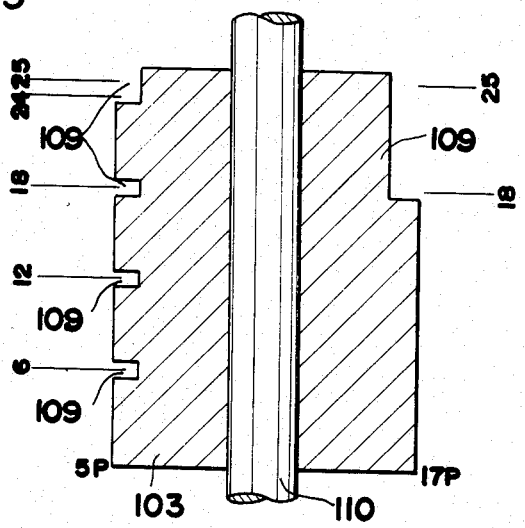
FIG. 15 is a cross-sectional view taken along the line 15—15' in FIG. 12.

The grooved roller 103 has cam grooves 109 adapted to receive the projection 105 of the selecting blade 102. When the projection 105 fits in the cam groove 109, the wire holding pawl 104 protrudes into the guide groove 95 through the opening 108 as shown in FIG. 12, thereby preventing the wire from passing through the guide groove 95. As best shown in FIG. 13, some of the wires are selectively held by the wire holding pawls 104, and the others are free from the pawls 104. In the embodiment illustrated in FIG. 13, the wires $2_1$ to $2_{20}$ are free from the pawls 104, and are fed to the connector attaching device 11. The wires $2_{21}$ to $2_{25}$ are pressed by the wire holding pawls 104, and are not fed to the connector attaching device 11. The feeding of the wires to the device 1 is effected by the second chuck 92 and the wire measuring and feeding device 14 operable therewith.

The wires are selected in accordance with the desired number of the connectors 3 and the desired number of poles thereof, and the cam grooves are produced in a close relationship with the connectors 3.

Figure 16:
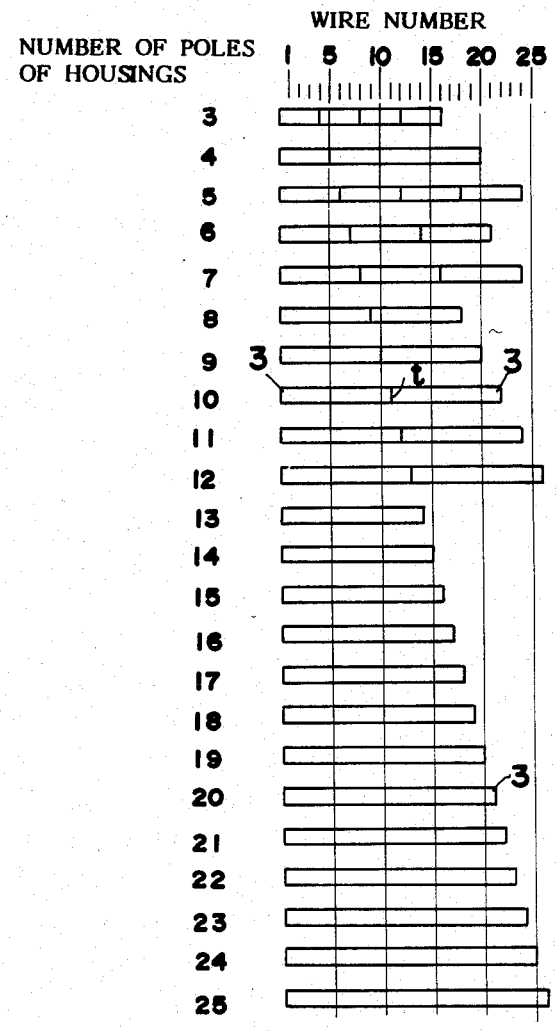
FIG. 16 is a graphical illustration of a relationship between the number of poles of connectors and the wires to be selected.

FIG. 16 illustrates what positions of wires are held from being fed in relationship with the connectors to be attached, wherein the vertical axis represents the number of poles of the connectors 3, and wherein the horizontal axis represents the wire number No. 1 to No. 25. The chart illustrates what lengths and how many of connectors 3 correspond to the desired number of poles of the connectors 3. Based on this chart an example will be described:

Assuming the connectors have twenty poles are to be attached to the desired wire group 2A. It is necessary to prevent the wires $2_{21}$ to $2_{25}$ from being fed. For this purpose the selecting blades 102 corresponding to the wires $2_{21}$ to $2_{25}$ are operated to enable their pawls 104 to hold these wires.

The connectors having ten poles can be attached in two pieces to the wires. In graphical illustration of FIG. 16 the letter (t) indicates the border between two connectors to be attached to one wire. In this case, it is necessary to hold the wire $2_{11}$ corresponding to wire No. 11 and the wires $2_{22}$ to $2_{25}$ corresponding to wire Nos. 22 to 25.

As referred to above, the number of connectors and the number of poles thereof determine the wires to be fed and not fed. The grooved roller 103 is provided with a number of cam grooves 109 at a periphery, thereof wherein the number of the grooves is determined in accordance with the graphical illustration of FIG. 16. FIG. 12 shows a shape on an enlarged scale of the grooves 109. It will be noted that the entire peripheral surface of the roller 103 is divided equally into twenty-four sections, at 15° divergences from the center, which correspond to the number of poles of the connectors 3. The cam grooves 109 are located at positions determined in accordance with the graphical illustration of FIG. 16 in such a manner so as to correspond to non-feeding wires, wherein the cam grooves 105 are aligned on straight lines drawn on the peripheral surfaces of the roller 103, and the positions thereof are decided by phasic angles determining the number of poles of the connectors.

The grooved roller 103 has a rotary shaft 110, which is rotatively coupled to the chuck body, and which is driven by a pulse motor 111 mounted thereon. The roller 103 is rotated 15° by 15° through a pinion 112 fixed to the driving shaft of the motor 111 and a gear 113 fixed to the rotary shaft 110 of the roller 103. When the number of poles of the connectors are determined, the corresponding cam grooves 109 are accordingly selected. Then the roller 103 is rotated until the selected cam groove 109 engages the projection 105 of the blade 102.

The two chucks 91, 92 and the wire guide 93 are withdrawn along the wire feed path W by the pneumatic cylinders 98 and 99 when the connector attaching operation is started, and while the attaching operation is in process, they are at rest at their regular positions.

As shown in FIGS. 1, 2 the wire measuring and feeding device 14 includes a movable chuck 115 reciprocal along the wire feed path W, and an auxiliary chuck 116 fixed at a constant position. Both chucks 115, 116 hold the wire group 2A across the wire feed path W. The movable chuck 115 is coupled to a chain unit, which includes a driving chain 119 supported on a pair of sprockets 117, 118. The sprocket 117 is driven by a d.c. motor 120, which is rotated in a clockwise or counterclockwise direction. The movable chuck 115 is reciprocated along the wire feed length W by driving the motor 120 in either direction. It is arranged that the chuck 115 can be stopped at a desired place. The lengths of the wires are decided by determining the amount of movement and the frequencies of reciprocal movement of the movable chuck 115. In this way the measuring of the wires to be fed is effected.

Figure 17A:
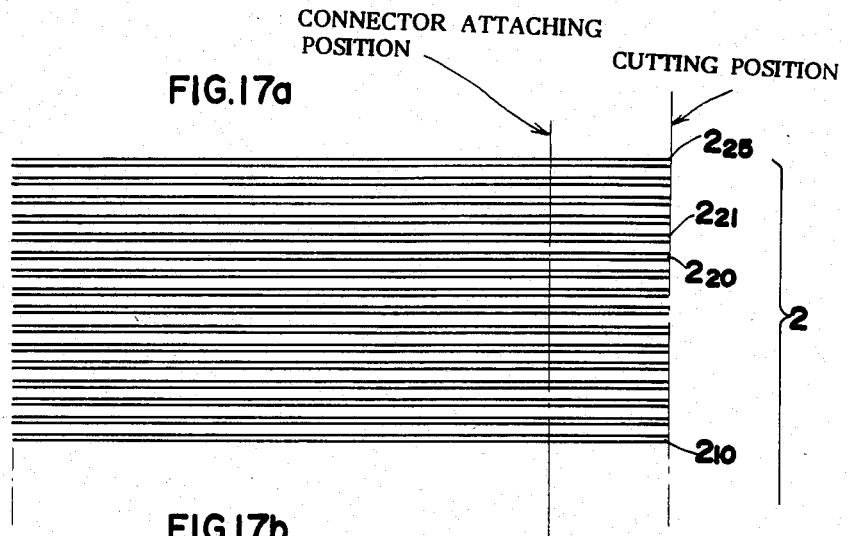
FIGS. 17(*a*) to (*c*) are views illustrating the movements of the end portions of the wires when the connector attaching operation is started.
Figure 17B:
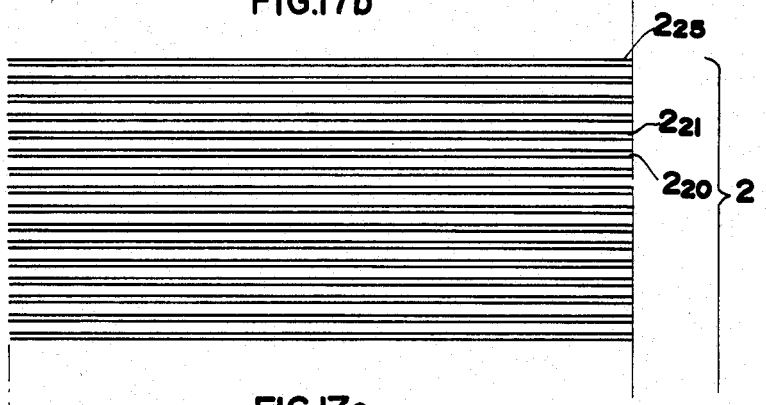
Figure 17C:
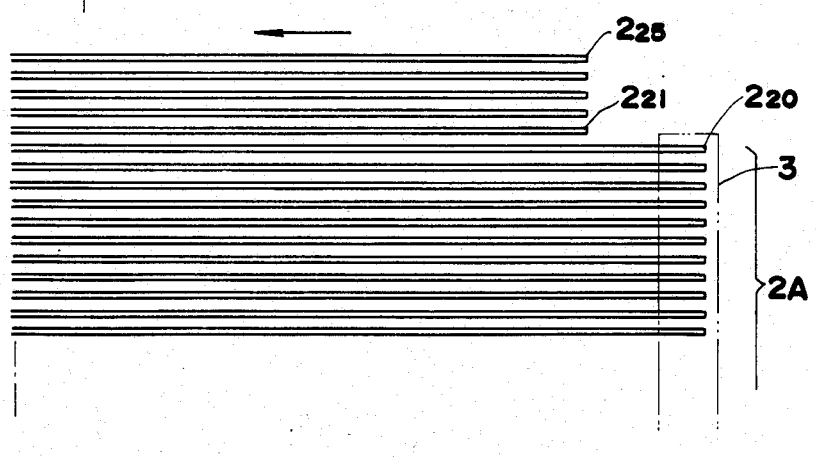
Figure 18A:
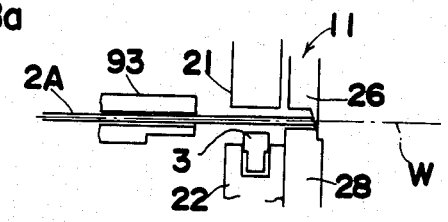
FIGS. 18(*a*) to (*g*) are views illustrating the sequence of connector attaching operations.
Figure 18B:
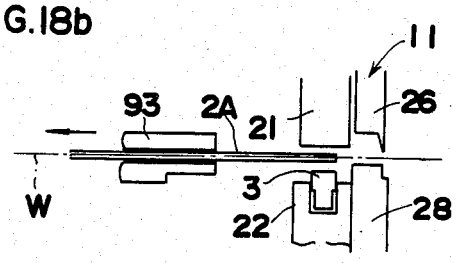
Figure 18C:
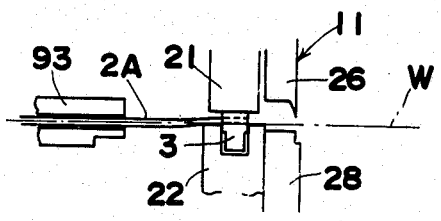
Figure 18D:
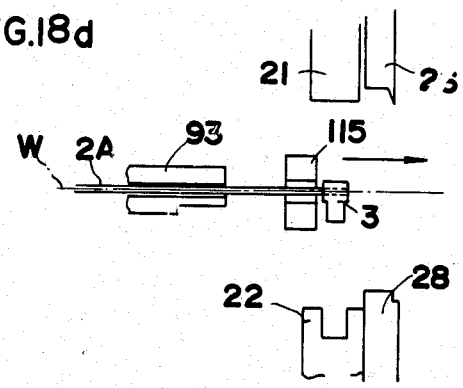
Figure 18E:
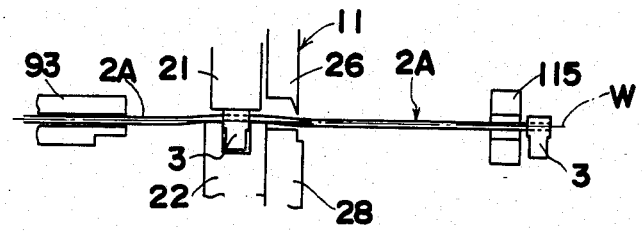
Figure 18F:
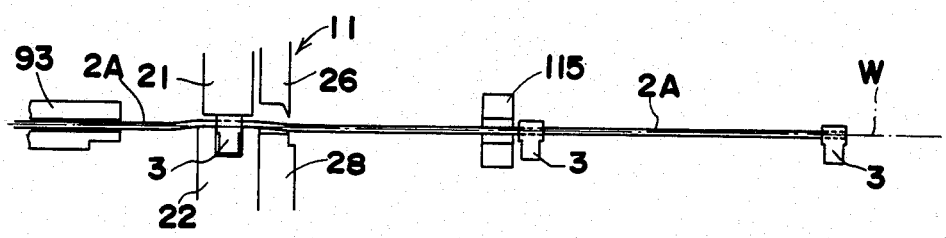
Figure 18G:
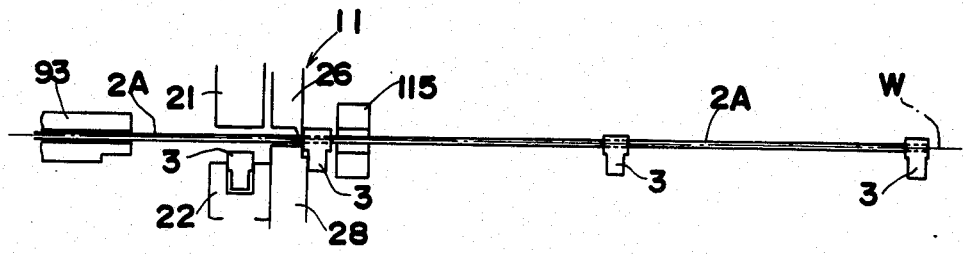

A typical example of the operation will be described:

FIGS. 17 (*a*), (*b*) and (*c*) show the top end portions of the wires in process at the initial time of connector attaching operation, and FIGS. 18 (*a*), (*b*) and (*c*) diagrammatically show the connector attaching operation. At the start of the operation the wire group 2 is fed to the connector attaching device 11 through the guide grooves 94, 95 and 96 of the chucks 91, 92 and the wire guide 93, respectively. When the wires are fed at a point where the punch 21 and the die 22 come together, the wires are cut at their top end portions by the cutter 26 lowered by the pneumatic cylinder 25 (FIG. 17(*a*) and FIG. 18(*a*)).

Then, the pneumatic cylinder 101 is operated causing the holder plate 100 to hold all the wires, and at this situation the chucks 91, 92 and the wire guide 93 are situated about 14 mm alongside the wire feed path W. The cut ends of the wires are also withdrawn to the connector attaching position (FIG. 17(*b*) and FIG. 18(*b*). Subsequently, the selecting blades 102 of the second chuck 92 are operated by the grooved roller 103, so as to hold the wires to which the connectors are not attached; in the illustrated embodiment, the wires $2_{21}$ to $2_{25}$ are held from being fed. At this stage, the second chuck 92 is further withdrawn by the pneumatic cylinder 99, thereby causing the held wires $2_{21}$ to $2_{25}$ to be equally withdrawn from the connector attaching position. In this way the desired wire group $2_1$ to $2_{20}$ alone are placed at the connector attaching position during which the cutter 26 is raised to its original upper position. Finally the die 22 is raised to the position shown in FIG. 5, thereby effecting the connector attaching operation (FIG. 17(*c*) and FIG. 18(*c*)).

As described above, the connectors are attached to the desired wire group 2A, and the punch 21 and the die 22 are raised to the respective original positions shown in FIG. 3. At this stage the movable chuck 115 is moved up to the connector attaching position, and holds the connector attached wire group individually (FIG. 18(*d*)). The chuck 91 is operated by the pneumatic cylinder 101 so as to release the wire group 2 from the holder plate 100. The movable chuck 115 is advanced along the wire feed path W, and pull the wires by the fixed length from the connector attaching device 11 together with the connectors 3. In this way the wires 2A are stretched between the two chucks 91, 115. At this stage the connector attaching device 11 is operated to attach the connectors 3 to the wire ends (FIG. 18(*e*)).

Likewise, the movable chuck 115 holds the wires 2A and pull them by a fixed length. The third connectors 3 are attached to the wire group 2A (FIG. 18(*f*)). Subsequently, the movable chuck 115 is moved to near the connectors attached to the wire ends so as to hold the wires and pull them to a position at which the left-hand sides of the connectors 3 are slightly separated from the cutter 26. At this moment the cutter 26 is operated to cut the wires 2A (FIG. 18(*g*)).

By the sequence of operations described above hardnesses 7 shown in FIG. 19(*a*) are produced with the connectors 3 at both ends and in the middle thereof.

Figure 19A:
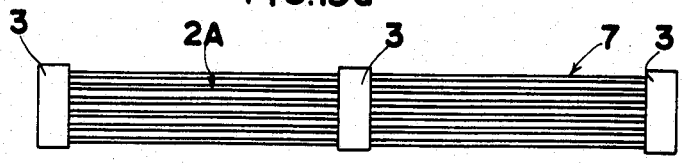
FIGS. 19(*a*) to (*d*) are plan views showing various types of harnesses produced in accordance with the present invention.
Figure 19B:
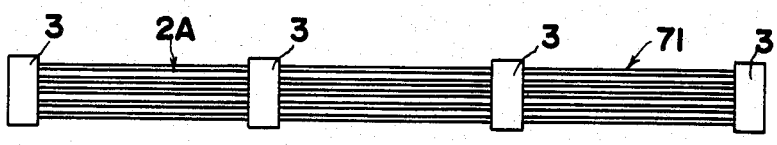
Figure 19C:
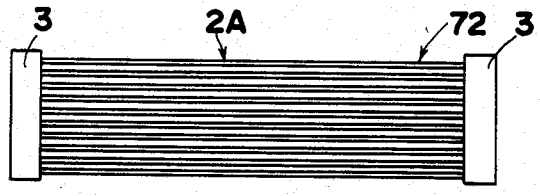
Figure 19D:
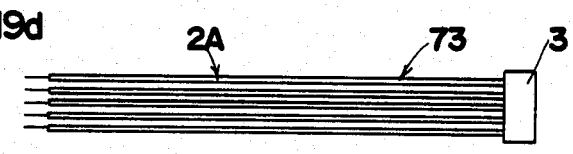
Figure 20:
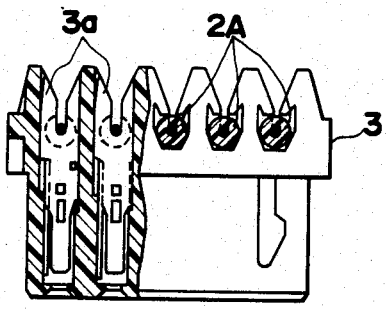
FIG. 20 is a partial cross-sectional view of a connector in which the wires are pressedly loaded.

As described above, the connectors having a desired number of poles and the wire group corresponding thereto are selected and supplied by the connector selecting and supplying device 12 and the wire selecting and supplying device 13. Likewise, harnesses 71 of the type shown in FIG. 19(*b*) are produced with one connector at each end and two connectors 3 between the ends. Alternatively, the harnesses 72 shown in FIG. 19(*c*) are produced with the connectors 3 at both ends alone. The harnesses 73 of the type shown in FIG. 19*d* are provided with the connectors at one end, and none of them at the other end.

Figure 21:
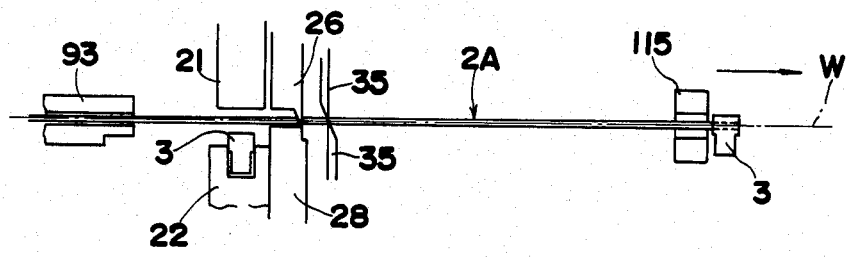
FIG. 21 is a view exemplifying another example of the connector attaching operation.

When the harnesses of the type of FIG. 19(*d*) are to be produced, an insulating cover stripper 35 is preferably located adjacent to the cutter 26 as shown in FIG. 21, wherein the stripper 35 is operated independently of the cutter 26. The stripper 35 removes the insulating covering so as to allow the conductors to be outside as shown in FIG. 19(*d*). The stripping is performed simultaneously with the cutting of the wires.

As evident from the foregoing description, the locations, number, and intervals of the connectors to be attached to the wires can be determined as desired, thereby producing a variety of harnesses to the users' demand. The intervals of the connectors are prolonged by causing the movable chuck 115 to reciprocate so as to pull the wires to a desired length along which the connectors are attached at intervals of a desired length.

In the illustrated embodiments pneumatic cylinders are used, but instead of them, hydraulic cylinders can be also used.

What is claimed is:

1. An apparatus for manufacturing electrical harnesses including wires and electrical connectors, the apparatus comprising a wire feed path extending horizontally and axially of the apparatus, a connector attaching device located along side the wire feed path including a punch and a die for pressing the wires into the connectors, and a cutter located adjacent to the punch and die such that the cutter is operated independently of the punch and die, a wire measuring and feeding device reciprocable along the wire feed path including an intermittently movable chuck whereby the connected-attached wires are pulled to a desired length, a connector selecting and supplying device whereby the connectors having a desired number of poles are selected from connectors and supplied onto the die, a wire selecting and supplying device including a chuck for selecting the wires corresponding to the selected connectors and supplying the selected wires to the connector attaching device, wherein the wire selecting and supplying device is adapted to hold wires fed from reels, an amount of movement and frequency of the reciprocal movements of the movable chuck being predetermined as desired, an operation of the cutter being effected only when the movable chuck is at rest, thereby insuring that various types of harnesses are produced in which the number of poles of the connectors, the number and position thereof and intervals thereof are determined as desired, and wherein an insulating covering stripper is provided whereby the insulating covering of the wires is removed, the stripper being located adjacent to the cutter and operable independently thereof.

2. An apparatus as defined in claim 1, wherein the cutter is carried on a slider on which the punch is mounted.

3. An apparatus as defined in claim 1, wherein the connector selecting and supplying device comprises a plurality of feeders whereby the connectors are fed in a predetermined posture, a first chute including a plurality of guide grooves through which connectors having different number of poles are selectively fed, the chute being movable in parallel with the wire feed path, a second chute through which the connectors are transferred from the feeder to a selected guide groove of the first chute, a third chute for separating the connectors to be used in one connector attaching operation from those fed through the guide grooves of the first chute, and a pusher for pushing the connectors separated by the third chute onto the die.

4. An apparatus as defined in claim 3, wherein the second chute is separable from the first chute so as to stop supplying the connectors by being separated therefrom when the type of the connectors accommodated in the guide grooves is not in accord with that of the connectors fed therethrough.

5. An apparatus for manufacturing electrical harnesses including wires and electrical connectors, the apparatus comprising a wire feed path extending horizontally and axially of the apparatus, a connector attaching device located along side the wire feed path including a punch and a die for pressing the wires into the connectors, and a cutter located adjacent to the punch and die such that the cutter is operated independently of the punch and die, a wire measuring and feeding device reciprocable along the wire feed path including an intermittently movable chuck whereby the connected-attached wires are pulled to a desired length, a connector selecting and supplying device whereby the connectors having a desired number of poles are selected from connectors and supplied onto the die, a wire selecting and supplying device including a chuck for selecting the wires corresponding to the selected connectors and supplying the selected wires to the connector attaching device, wherein the wire selecting and supplying device is adapted to hold wires fed from reels, an amount of movement and frequency of the reciprocal movements of the movable chuck being predetermined as desired, an operation of the cutter being effected only when the movable chuck is at rest, thereby insuring that various types of harnesses are produced in which the number of poles of the connectors, the number and position thereof and intervals thereof are determined as desired, said wire selecting and feeding device comprises a first chuck for holding the wire group not expected to have the connectors attached thereto while releasing those expected to have the connectors attached thereto, a second chuck reciprocably movable along the wire feed path and capable of stopping at a desired place, the second chuck being adapted to pull the desired wire group and feed the same to the connector attaching device intermittently by a desired length, the first chuck comprising a plurality of guide grooves whereby the wires are held at equal intervals, and plurality of selecting blades individually insertable into the guide grooves thereby securing the wires accommodated therein and means for operating the selecting blades individually and selectively, and wherein the blade operating means comprises a roller having a plurality of cam grooves on a peripheral surface thereof, the cam grooves being adapted to receive the selecting blades individually and selectively, the roller allowing the selecting blade engaged in the cam grooves to come into engagement with the guide grooves of the first chuck so as to hold the wires accommodated therein.

6. As an apparatus for manufacturing electrical harnesses including wires and electrical connectors, the apparatus comprising a wire feed path extending horizontally and axially of the apparatus, a connector attaching device located along side the wire feed path including a punch and a die for pressing the wires into the connectors, and a cutter located adjacent to the punch and die such that the cutter is operated independently of the punch and die, a wire measuring and feeding device reciprocable along the wire feed path including an intermittently movable chuck whereby the connected-attached wires are pulled to a desired length, a connector selecting and supplying device whereby the connectors having a desired number of poles are selected from connectors and supplied onto the die, a wire selecting and supplying device including a chuck for selecting the wires corresponding to the selected connectors and supplying the selected wires to the connector attaching device, wherein the wire selecting and supplying device is adapted to hold wires fed from reels, the amount of movement and frequencies of the reciprocal movements of the movable chuck being predetermined as desired, the operation of the cutter being effected only when the movable chuck is at rest, thereby insuring that various types of harnesses are produced in which the number of poles of the connectors, the number and position thereof and intervals thereof are determined as desired, a plurality of checking probes whereby an electrical connection between the conductors of the wires and the contacts of the connector is checked, each checking probe comprising a pin insertable in the connector, and being connected to a detector for ascertaining an electrical connection therebetween, and power source means for supplying an electric current through a circuit including the checking probes, the contacts of the connector, and the detector, and wherein the checking probe is mounted on a slider provided for raising and lowering the die.

7. An apparatus as defined in claim 6, wherein the detector is a lamp or a buzzer.

* * * * *